US006807383B2

(12) United States Patent
Kawagoe

(10) Patent No.: US 6,807,383 B2
(45) Date of Patent: Oct. 19, 2004

(54) APPARATUS, SYSTEM FOR FORMING IMAGE, AND METHOD FOR CONTROLLING IMAGE FORMING APPARATUS

(75) Inventor: Katsumi Kawagoe, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/630,830

(22) Filed: Jul. 31, 2003

(65) Prior Publication Data

US 2004/0057744 A1 Mar. 25, 2004

(30) Foreign Application Priority Data

Jul. 31, 2002 (JP) ..... P2002-223512

(51) Int. Cl.[7] ..... B41L 13/04; B65H 31/34; G03G 15/00

(52) U.S. Cl. ..... 399/45; 101/2; 101/232; 399/8; 399/16; 399/82; 399/405

(58) Field of Search ..... 399/45, 82, 8, 399/16, 389, 391, 405, 407; 101/2, 232, 240

(56) References Cited

U.S. PATENT DOCUMENTS 5,404,805 A * 4/1995 Fujimoto et al. ..... 101/2 X
5,598,258 A * 1/1997 Sato et al. ..... 399/16 X
6,748,858 B2 * 6/2004 Yamaguchi ..... 101/232

FOREIGN PATENT DOCUMENTS

| | | | |
|---|---|---|---|
| JP | 60-220752 | | 11/1985 |
| JP | 10-001254 | | 1/1998 |
| JP | 10-056908 | * | 3/1998 |
| JP | 11-060028 | | 3/1999 |
| JP | 2000-177916 | * | 6/2000 |
| JP | 2002-037513 | * | 2/2002 |

* cited by examiner

*Primary Examiner*—Sophia S. Chen
(74) *Attorney, Agent, or Firm*—Nath & Associates PLLC

(57) ABSTRACT

An image forming apparatus includes: a plurality of paper supply sections having a paper size sensor to detect a size of a print paper; an image forming section forming an image on the fed print paper; a paper discharge section stocking the print paper formed of the image and discharged; an auto fence located on the paper discharge section, and displacing the position of a width direction of the print paper stocked on the paper discharge section according to the paper size of the print paper fed from the paper supply sections; a storage section storing the image forming processing as the printing job in the image for one page unit; and a control section determining a sequence of each printing job stored in the storage section so that printing processing is executed in order from a printing job with the smallest paper size in the width direction.

17 Claims, 11 Drawing Sheets

APPARATUS, SYSTEM FOR FORMING IMAGE, AND METHOD FOR CONTROLLING IMAGE FORMING APPARATUS

BACKGROUND OF THE INVENTION

1. Field of the Invention

The present invention pertains to an apparatus, a system and a method for forming an image, including an automatic fence unit to at least adjust a fence width automatically according to the size of paper transferred to a paper receiving tray.

2. Description of the Related Art

Conventionally, for an image forming apparatus, such as a printer or a copier, an automatic fence unit to adjust a fence width automatically according to the size of paper transferred to a paper receiving tray is disclosed in Japanese Patent Laid Open Publication (Kokai) No. S60-220752, No. H10-001254, and No. H11-060028. The image forming apparatus having the automatic fence can discharge the printed paper according to two or more kinds of paper sizes automatically, and a user can be saved the work of manually adjusting the fence of a paper receiving tray according to the printed paper size.

After performing image forming processing for the number of sheets which are not filled with a first paper size into the maximum discharge loading capacity of the paper receiving tray, when image forming processing is performed using a large size paper than the first paper size, the image forming apparatus having the automatic fence such as described above can perform image forming processing continuously to stock the printed paper on the paper receiving tray by moving in the direction the auto fence spreads more from the first position.

However, when continuing the image forming processing using a paper smaller than the first paper size, since the paper of the first paper size stacked on the paper receiving tray serves as an obstacle, the automatic fence is unable to move inside. Therefore, unless the printed paper stacked on the paper receiving tray is removed, the image forming processing cannot continue. This can become a significant problem especially, when the maximum discharge loading capacity of the paper receiving tray is large and when the number of paper sheets of each paper size of the image forming processing is low, or when operating the image forming apparatus from a remote place.

SUMMARY OF THE INVENTION

An apparatus for forming an image according to an embodiment of the present invention includes: (a) a plurality of paper supply sections having a paper size sensor to detect a size of a print paper set on; (b) an image forming section forming an image on the print paper fed from the paper supply sections; (c) a paper discharge section stocking the print paper formed of the image and discharged; (f) an auto fence located on the paper discharge section, and displacing the position of a width direction of the print paper stocked on the paper discharge section according to the paper size of the print paper fed from the paper supply sections; (g) a storage section storing the image forming processing as the printing job in the image for one page unit; and (h) a control section determining a sequence of each printing job stored in the storage section so that printing processing is executed in order from a printing job with the smallest paper size in the width direction of the print paper.

Further, a system for forming an image according to an embodiment of the present invention includes (a) an information processing apparatus for inputting an original image and image forming processing information including at least information about the image formation sheet number, and (b) an apparatus for forming an image including: a controller receiving the original image and the image forming processing information from the information processing apparatus; a plurality of paper supply sections having a paper size sensor to detect a size of a print paper set on; an image forming section forming an image on the print paper fed from the paper supply sections, based on the original image; a paper discharge section to stock the print paper formed of the image and discharged; an auto fence located on the paper discharge section, to displace the position of a width direction of the print paper stocked on the paper discharge section according to the paper size of the print paper fed from the paper supply sections; a storage section to store the image forming processing as the printing job in the image for one page unit; and a control section determining a sequence of each printing job stored in the storage section so that printing processing is executed in order from a printing job with the smallest paper size in the width direction of the print paper.

Furthermore, a method for controlling an image forming apparatus according to an embodiment of the present invention includes: (a) detecting a size of a print paper set on a plurality of paper supply sections; (b) storing image forming processing as the printing job in the image for one page unit in a storage section; (c) determining a sequence of each printing job stored in the storage section so that printing processing is executed in order from a printing job with the smallest paper size in a width direction of the print paper; and (d) displacing of the position of the width direction of the print paper stocked on the paper discharge section according to the paper size of the printing job, feeding the print paper from the paper supply sections, forming an image on the print paper fed from the paper supply sections in an image forming section, and discharging and stocking the print paper formed of the image on a paper discharge section, are executed according to the sequence.

DETAILED DESCRIPTION

Figure 1:
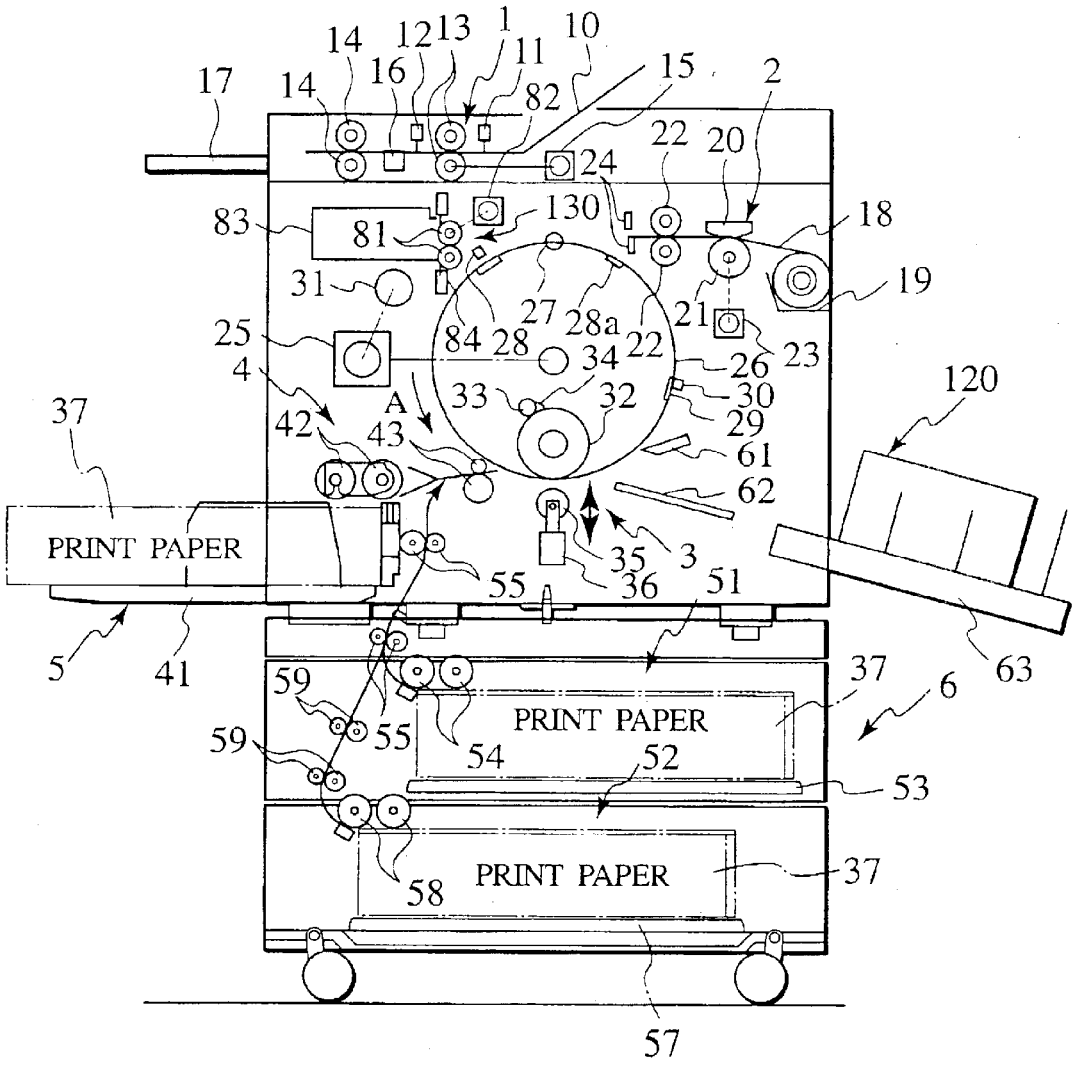
FIG. 1 is an internal schematic structure diagram showing a stencil printing apparatus according to an embodiment of the present invention.
Figure 2:
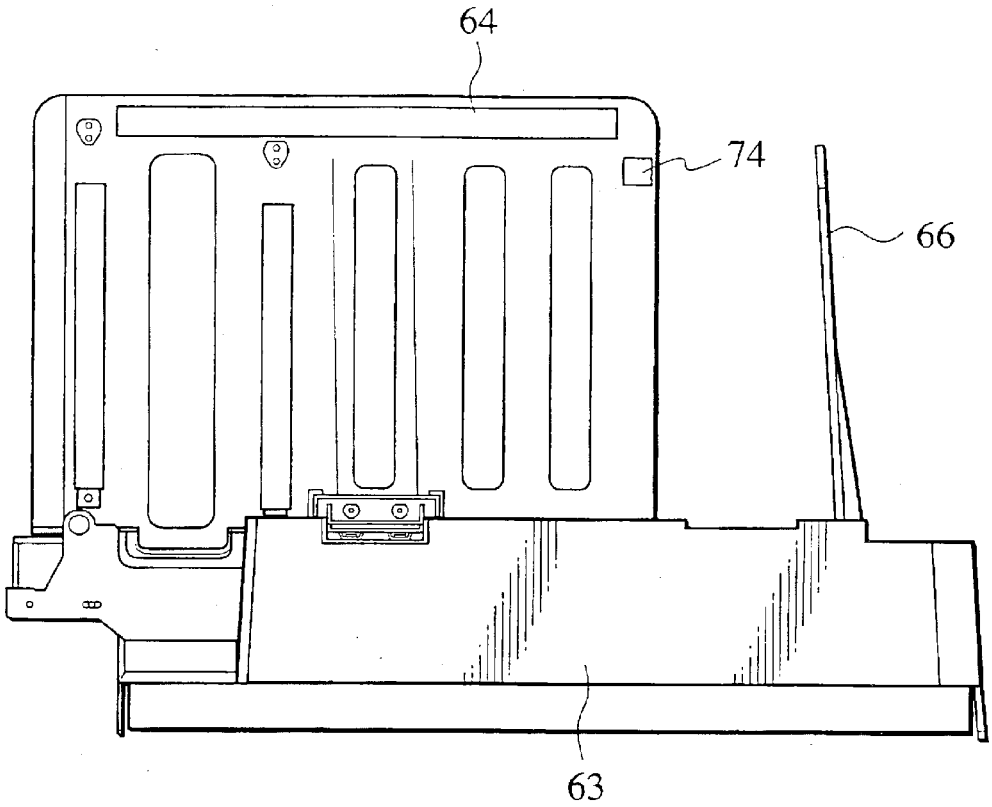
FIG. 2 is a side view of a paper discharge section in the stencil printing apparatus shown in FIG. 1.
Figure 3:
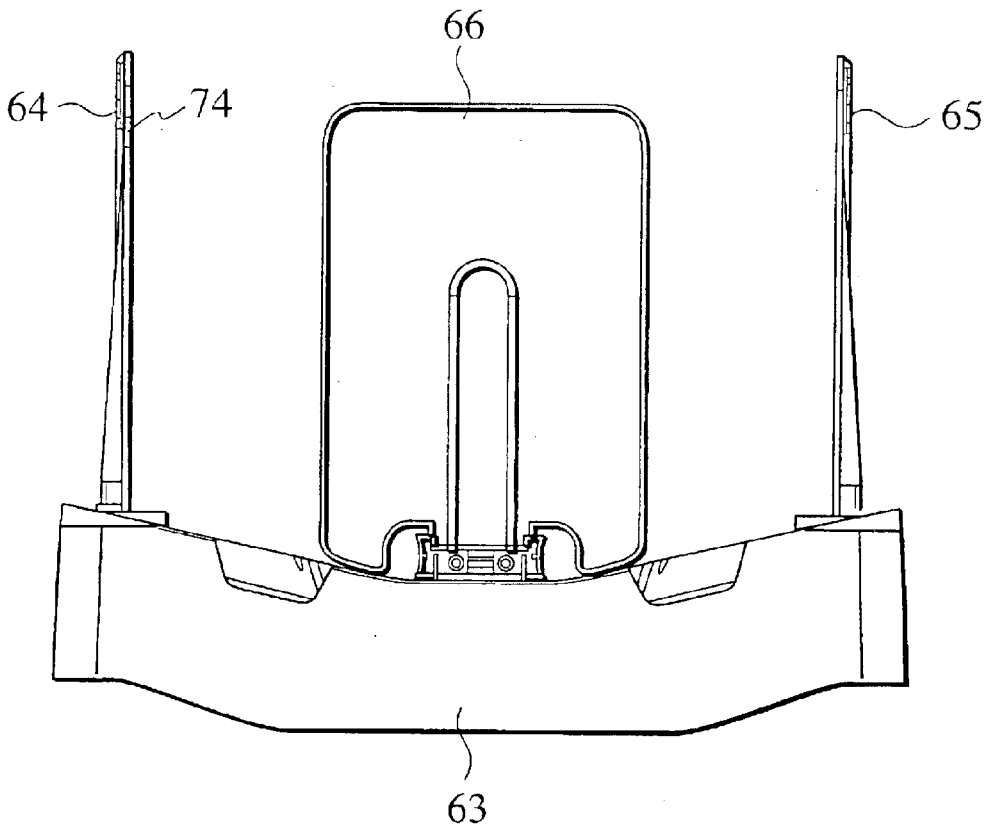
FIG. 3 is a front view of the paper discharge section in the stencil printing apparatus shown in FIG. 1.
Figure 4:
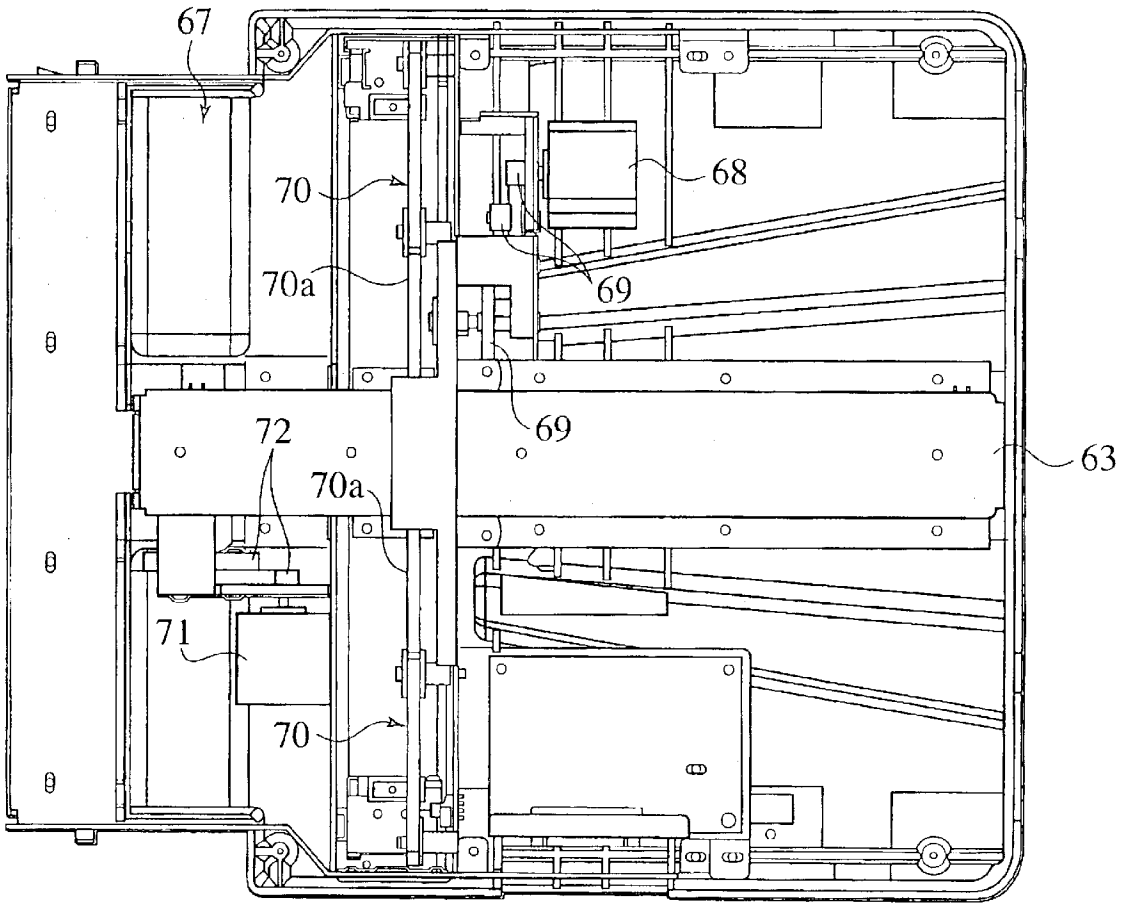
FIG. 4 is a bottom view of the paper discharge section in the stencil printing apparatus shown in FIG. 1.
Figure 5:
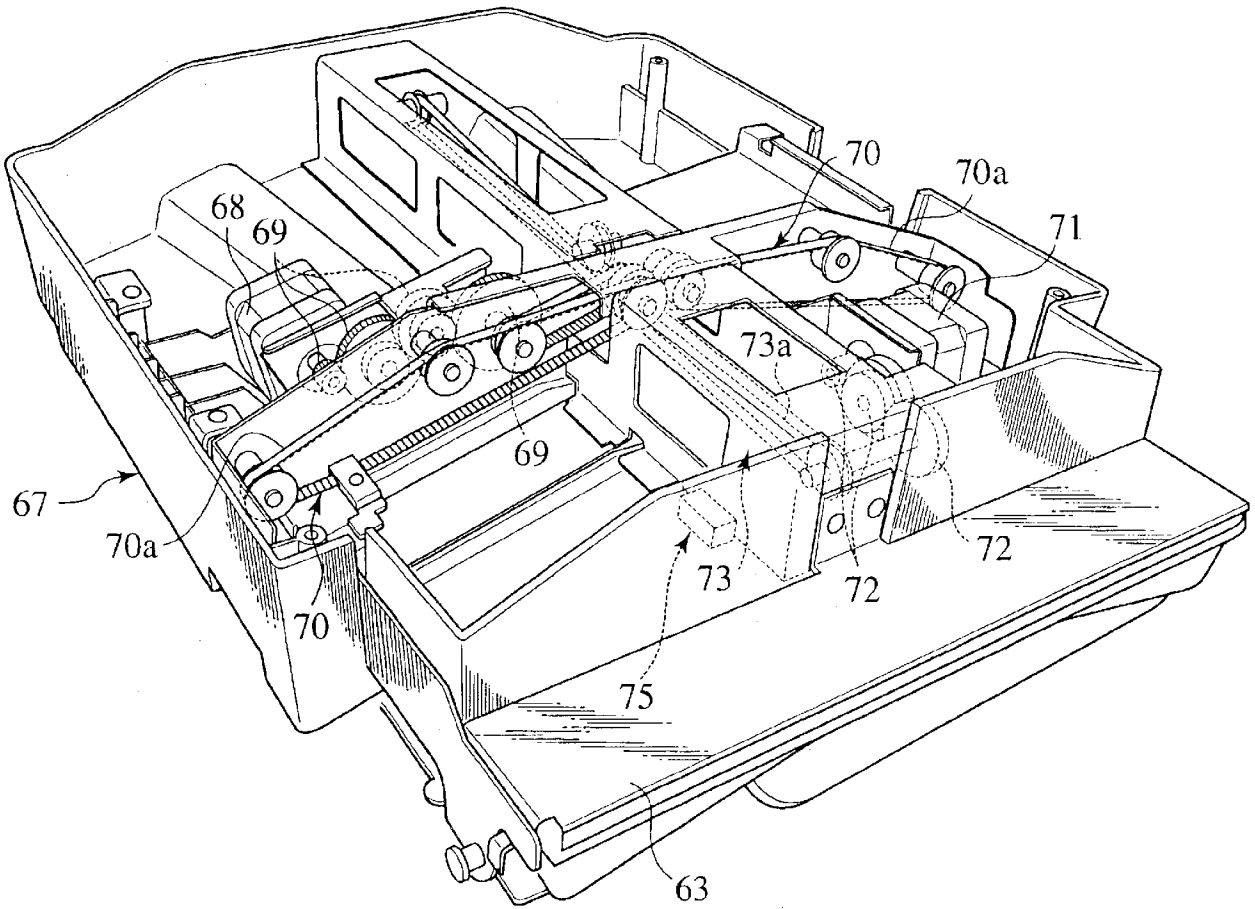
FIG. 5 is a fragmentary perspective view of the paper discharge section seen from the bottom, in the stencil printing apparatus shown in FIG. 1.

The present embodiment aims to disclose an apparatus a system, and a method for forming an image, including an automatic fence unit in order to continuously perform image forming processing for a plural of paper sizes.

An apparatus for forming an image according to the present embodiment includes: (a) a plurality of paper supply sections having a paper size sensor to detect a size of a print paper set on; (b) an image forming section forming an image on the print paper fed from the paper supply sections; (c) a paper discharge section stocking the print paper formed of the image and discharged; (f) an auto fence located on the paper discharge section, and displacing the position of a width direction of the print paper stocked on the paper discharge section according to the paper size of the print paper fed from the paper supply sections; (g) a storage section storing the image forming processing as the printing job in the image for one page unit; and (h) a control section determining a sequence of each printing job stored in the storage section so that printing processing is executed in order from a printing job with the smallest paper size in the width direction of the print paper.

Further, a system for forming an image according to the present embodiment includes (a) an information processing apparatus for inputting an original image and image forming processing information including at least information about the image formation sheet number, and (b) an apparatus for forming an image including: a controller receiving the original image and the image forming processing information from the information processing apparatus; a plurality of paper supply sections having a paper size sensor to detect a size of a print paper set on; an image forming section forming an image on the print paper fed from the paper supply sections, based on the original image; a paper discharge section to stock the print paper formed of the image and discharged; an auto fence located on the paper discharge section, to displace the position of a width direction of the print paper stocked on the paper discharge section according to the paper size of the print paper fed from the paper supply sections; a storage section to store the image forming processing as the printing job in the image for one page unit; and a control section determining a sequence of each printing job stored in the storage section so that printing processing is executed in order from a printing job with the smallest paper size in the width direction of the print paper.

Furthermore, a method for controlling an image forming apparatus according to the present embodiment includes: (a) detecting a size of a print paper set on a plurality of paper supply sections; (b) storing image forming processing as the printing job in the image for one page unit in a storage section; (c) determining a sequence of each printing job stored in the storage section so that printing processing is executed in order from a printing job with the smallest paper size in a width direction of the print paper; and (d) displacing of the position of the width direction of the print paper stocked on the paper discharge section according to the paper size of the printing job, feeding the print paper from the paper supply sections, forming an image on the print paper fed from the paper supply sections in an image forming section, and discharging and stocking the print paper formed of the image on a paper discharge section, are executed according to the sequence.

According to the above composition, the positions of the auto fence controlled so as to be are moved in the spreading direction as the paper size shifts to with a large paper size to perform image forming processing from a printing job with the smallest size of the print paper when two or more printing jobs are stored in the storage section. Therefore, even if the print paper currently stocked onto the paper discharge section is not removed, the image forming processing of two or more paper sizes can be performed continuously.

In addition, the "auto fence" displacing the position of the width direction of the print paper contains, for example, the pair of side fences, regulate the side edge of the discharged print paper in order to displace the position of the width direction of the print paper.

Further, the auto fence can also be considered as a composition including the end fence in which the edge of the print paper interferes, and the end fence displaces the position of the conveyance direction of the print paper.

Furthermore, the above-mentioned image forming apparatus can also be considered as the composition including an original scanning section reading an original image of two or more paper sizes, and an input section inputting the image formation processing information including at least information about the image formation sheet number. That is, the apparatus stores the image data read by the original scanning section and the information of the image forming processing inputted from the input section, and controls to perform image forming from a job with the smallest paper size when two or more printing jobs are stored in the storage section. According to the above composition, it can use as image forming apparatus that is operated on the stand-alone.

Moreover, the above-mentioned apparatus can also be considered as the composition including comprising a controller connecting with the information processing apparatus, and receiving the original image and the image forming processing information including at least the information about the number of the sheets of the picture formation from the information processing apparatus.

In addition, the "information processing apparatus" includes the apparatus for creating and inputting the original image formed with the image forming apparatus, such as image input apparatus, a word processing apparatus, a personal computer and a word processor, a digitizer, and an image scanner.

Further, the controller can be connected with the information processing apparatus via a network. By such composition, the original image of two or more paper sizes can be transmitted to the image forming apparatus from the information processing apparatus stationed in a remote place, and two or more image forming processes can be executed continuously.

Various embodiments of the present invention will be described herein below with reference to the accompanying FIGS. 1 through 9B. It is to be noted that the same or similar reference numerals are applied to the same or similar parts and elements throughout the drawings, and the description of the same or similar parts and elements will be omitted or simplified.

An image forming apparatus concerning the present embodiment, for example, can be constituted as a stencil printing apparatus as shown in FIG. 1.

Components of Stencil Printing Apparatus

As shown in FIG. 1, a stencil printing apparatus includes an original scanning section 1, a stencil making section 2, a printing section (image forming section) 3, a paper supply section 4, a paper discharge section 120 and a stencil discharge section 130, as main components.

Original Scanning Section

The original scanning section 1 is composed of an original set tray 10, a reflected-type original sheet sensor 11 and 12, original feed rollers 13 and 14, a stepping motor 15, a contact-type image sensor 16, and an original discharge tray 17. An original, which is to be printed, is set on the original set tray 10. The original sheet sensors 11 and 12 detect the presence or absence of the original sat on the original set tray 10. The original feed rollers 13 and 14 are rotationally driven by the stepper motor 15 and thus transfer the original sat on the original set tray 10. The image sensor 16 optically scans the image data of the original transferred by the original feed rollers 13 and 14, and changes the read image data into an electric signal. The original discharge tray 17 stacks the original discharged from the original set tray 10.

Thus, the original stacked on the original set tray 10 is transferred by the original feed rollers 13 and 14, and the transferred original is read by the image sensor 16.

Stencil Making Section

The stencil making section 2 is composed of a stencil sheet container 19 containing the stencil sheet 18 shaped of long rolled lengths, a thermal print head 20 located downstream from the stencil sheet container 19, a platen roller 21 opposed to the thermal print head 20, a pair of stencil sheet feed rollers 22 located downstream from the thermal print head 20 and the platen roller 21, a write pulse motor 23 driving the rotation of the platen roller 21 and the stencil sheet feed rollers 22, and a cutter 24 located downstream from the pair of stencil sheet feed rollers 22.

The stencil sheet 18 shaped of long rolled lengths is transferred by rotation of the platen roller 21 and the stencil sheet feed rollers 22. Then, each of heat elements of the thermal print head 20 heats the transferred stencil paper selectively in order to make a stencil based on the image data read with the image sensor 16, and the cutter 24 cuts the perforated stencil sheet 18 to produce the perforated stencil sheet 18 to a predetermined length.

Printing Section

The printing section 3 is composed of a drum 26, a clamp section 27, a stencil sheet sensor 28, a fiducial position detection sensor 30, and a rotary encoder 31. The drum 26 is composed of ink permeable elements at its outer peripheral surface using a perforated structure, and rotated in the direction of arrow A of FIG. 1 by the drive force of the main motor 25. The clamp section 27 is located on the outer peripheral surface of the drum 26, and clamps the leading edge of the stencil sheet 18. The stencil sheet sensor 28 detects whether the perforated stencil sheet 18 is wound around the outer peripheral surface of the drum 26 by referencing a detection chip 28*a* of the drum 26. The fiducial position detection sensor 30 detects the fiducial position of the drum 26 by referencing a detection chip 29 of the drum 26. The rotary encoder 31 detects rotation of the main motor 25. The rotation position of the drum 26 is able to detect by referencing the output pulse of the rotary encoder 31 based on the detection output of the fiducial position detection sensor 30.

Further, the printing section 3 has a squeeze roller 32 located on the inner surface of the drum 26, and a doctor roller 33 located on close to the squeeze roller 32. Ink 34 is accumulated in the outer peripheral space surrounded with the squeeze roller 32 and the doctor roller 33. Since the ink 34 adhering to the periphery of the rotating squeeze roller 32 passes along the crevice between the doctor rolls 33, only the ink 34 of the predetermined thin film adheres to the squeeze roller 32, and the ink 34 of the predetermined thin film is supplied to the inner surface of the drum 26. Moreover, a press roller 35 is located on the opposite position of the squeeze roller 32 and on the peripheral position of the drum 26. The press roller 35 is able to move between a press position wherein it is pressed to the peripheral surface of the drum 26 by the driving force of a pressure solenoid 36, and a standby position wherein it is distanced from the peripheral surface of the drum 26. The press roller 35 is displaced to the press position from the standby position, synchronizing with the supplying of the print paper 37 by the paper supply section 4. That is, the press roller 35 is located in the press position only in the case where the print paper 37 passes the lower part of the drum 26, and is located in a standby position in other cases.

The clamp section 27 clamps the leading edge of the stencil sheet 23 which has been perforated and fed from the stencil making section 2. After being clamped, the perforated stencil sheet 18 is wound around the outer surface of the drum 26 by rotating the drum 26. Since the press roller 35 presses the print paper 37 fed from the paper supply section 4 toward to the perforated stencil sheet 18 synchronizing with the rotation of the drum 26, the ink 34 is transferred to the print paper 37 through the perforation of the perforated stencil sheet 18, and an image is printed on the print paper 37.

Paper Supply Section

The paper supply section 4 is composed of a main body paper supply section 5 and a paper supply frame 6.

The main body paper supply section 5 includes a main body tray 41 to stack the plurality of print paper 37, paper supply rollers 42 transferring the print sheets one by one from the top of the print paper 37 placed on the main body tray 41, and timing rollers 43 feeding the print paper 37 transferred by the paper supply rollers 42 to the area between the drum 26 and the press roller 35, synchronizing with the rotation of the drum 26.

Figure 7:
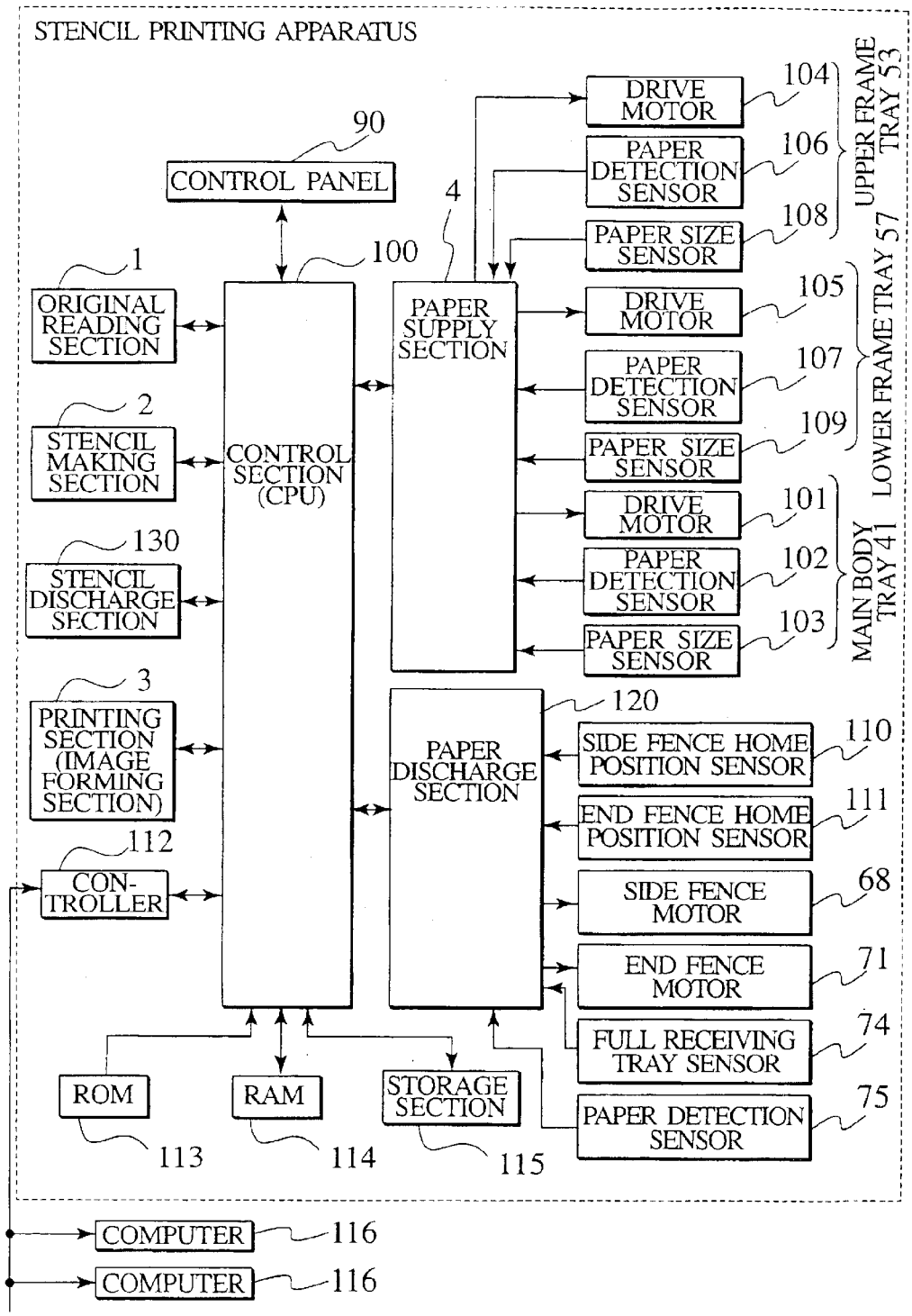
FIG. 7 is a block diagram for explaining the composition of the control section in the stencil printing apparatus shown in FIG. 1.

The paper supply rollers 42 are rotationally driven rotation by a drive motor 101 (shown in FIG. 7). Moreover, the main body tray 41 has a paper detection sensor 102 (shown in FIG. 7) to detect whether the print paper 37 is stacked, and a paper size sensor 103 (shown in FIG. 7) to detect the paper size of the print paper 37 stacked on the main body tray 41.

The paper supply frame 6 is composed of an upper paper supply frame 51 to feed the print paper 37 to the printing section 3, and a lower paper supply frame 52 to similarly feed the print paper 37 to the printing section 3.

The upper paper supply frame 51 includes an upper frame tray 53 to stack the plurality of print paper 37, paper supply rollers 54 transferring the print sheets one by one from the top of the print paper 37 placed on the upper frame tray 53, and two pairs of upper guide rollers 55 feeding the print paper 37 transferred by the paper supply rollers 54 to the timing rollers 43 of the main body paper supply section 5. The paper supply rollers 54 and the upper guide rollers 55 are rotationally driven by a drive motor 104 (shown in FIG. 7) of the upper paper supply frame 51. By the way, the upper guide rollers 55 are rotationally driven by a drive motor 104, and also are rotationally driven by a drive motor 105 (shown in FIG. 7) of the lower paper supply frame 52.

The lower paper supply frame 52 includes a lower frame tray 57 to stack the plurality of print paper 37, paper supply rollers 58 transferring the print sheets one by one from the top of the print paper 37 placed on the lower frame tray 57, and two pairs of lower guide rollers 59 feeding the print paper 37 transferred by the paper supply rollers 58 to the upper guide rollers 55 of the upper paper supply frame 51. The paper supply rollers 58 and the lower guide rollers 59 are rotationally driven by a drive motor 105 of the lower paper supply frame 52.

Further, the upper frame tray 53 has a paper detection sensor 106 (shown in FIG. 7) to detect whether the print paper 37 is stacked, and a paper size sensor 108 (shown in FIG. 7) to detect the paper size of the print paper 37 stacked on the upper frame tray 53. The lower frame tray 57 has a paper detection sensor 107 (shown in FIG. 7) to detect whether the print paper 37 is stacked, and a paper size sensor 109 (shown in FIG. 7) to detect the paper size of the print paper 37 stacked on the lower frame tray 57.

Paper Discharge Section

The paper discharge section 120 is composed of a separator 61 to separate the print paper 37 from the drum 26, a paper transfer passage 62 where the print paper 37 estranged from the drum 26 by the separator 61 is transferred, and a paper receiving tray 63 to stack the print paper 37 discharged through the paper transfer passage 62.

The paper receiving tray 63 is located in the position where the discharged print paper 37 falls. Further, a pair of side fences 64, 65 and an end fence 66 as paper stack fences are located on the paper receiving tray 63, as shown in FIGS. 2 to 5. The pair of side fences 64, 65 and the end fence 66 are able to move between an upright position to interfere with the discharged print paper 37 in order to regulate a stack position of the print paper 37, and an inclined position so as to not regulate the stack position of the print paper 37, respectively. Moreover, the pair of side fences 64 and 65 are symmetrical on the basis of a main position and adjustable to the right-and-left direction, and regulate the side edge of the discharged print paper 37. The end fence 66 regulates the leading edge of the print paper 37.

Then, the pair of side fences 64 and 65 and the end fence 66 are moved to the position corresponding to the paper size of the print paper 37 by a fence actuator 67 based on the detection result of the paper size. The fence actuator 67 has a side fence motor 68, plural gears 69 to slow down and transmit rotation of the side fence motor 68, and a symmetrical pair of timing belt actuators 70 which are moved, synchronizing with the output of the gears 69. Each of the side fences 64 and 65 is fixed to each timing belt 70*a* of the timing belt actuators 70. The side fences 64 and 65 are synchronized and moved by the drive of the side fence motor 68. Moreover, The fence actuator 67 has an end fence motor 71, plural gears 72 to slow down and transmit rotation of the end fence motor 71, and timing belt actuators 70 moved by the output of the gears 72. The end fence 66 is fixed to the timing belt 73*a* of the timing belt actuators 73. The end fence 66 is moved by the drive of the end fence motor 71.

Furthermore, the paper receiving tray 63 has the side fence home position sensor 110 (shown in FIG. 7) to detect a home position of the pair of side fences 64 and 65, and the end fence home position sensor 111 (shown in FIG. 7) to detect the home position of the end fence 66. The side fence home position sensor 110 determines the maximum width position of the pair of side fences 64 and 65 as the home position, respectively. And, the end fence home position sensor 111 determines the maximum front-end position in the conveyance direction of the end fence 66 as the home position.

Moreover, a (non-contact or contact) full receiving tray sensor 74 to detect that the print paper 37 is loaded to the limit on the paper receiving tray 63, is located on one side of the pair of the side fences 64 and 65. Further, the paper receiving tray 63 can be contained by the main body of the stencil printing apparatus in the state where all of the pairs of the side fences 64 and 65 and the end fences 66 are in the inclined position. Furthermore, a reflected type paper detection sensor 75 is located on the middle of the side fences 64 and 65.

In addition, the structure of the paper receiving tray 63 is not limited to the above-mentioned structure. For example, a paper receiving tray of a large-scale-type having a bottom paper stock can drive the rise-and-fall according to loading capacity, or, plural paper receiving trays arranged up-and-down or right-and-left which can choose the paper receiving tray by switching the paper transfer passage from the printing section to the paper discharge section, may be used as the paper receiving tray 63.

Stencil Discharge Section

The stencil discharge section 130 includes a pair of stencil disposal rollers 81 transferred while separating the used stencil sheet 18 from the drum 26, a stencil disposal motor 82 to drive the rotation of the stencil disposal rollers 81, a stencil disposal box 83 to contain the used stencil sheet 18 transferred by the stencil disposal rollers 81, and a stencil disposal sensor 84 to detect whether the used stencil sheet 18 is transferred into the stencil disposal box 83 by the stencil disposal rollers 81.

Control Panel

Figure 6:
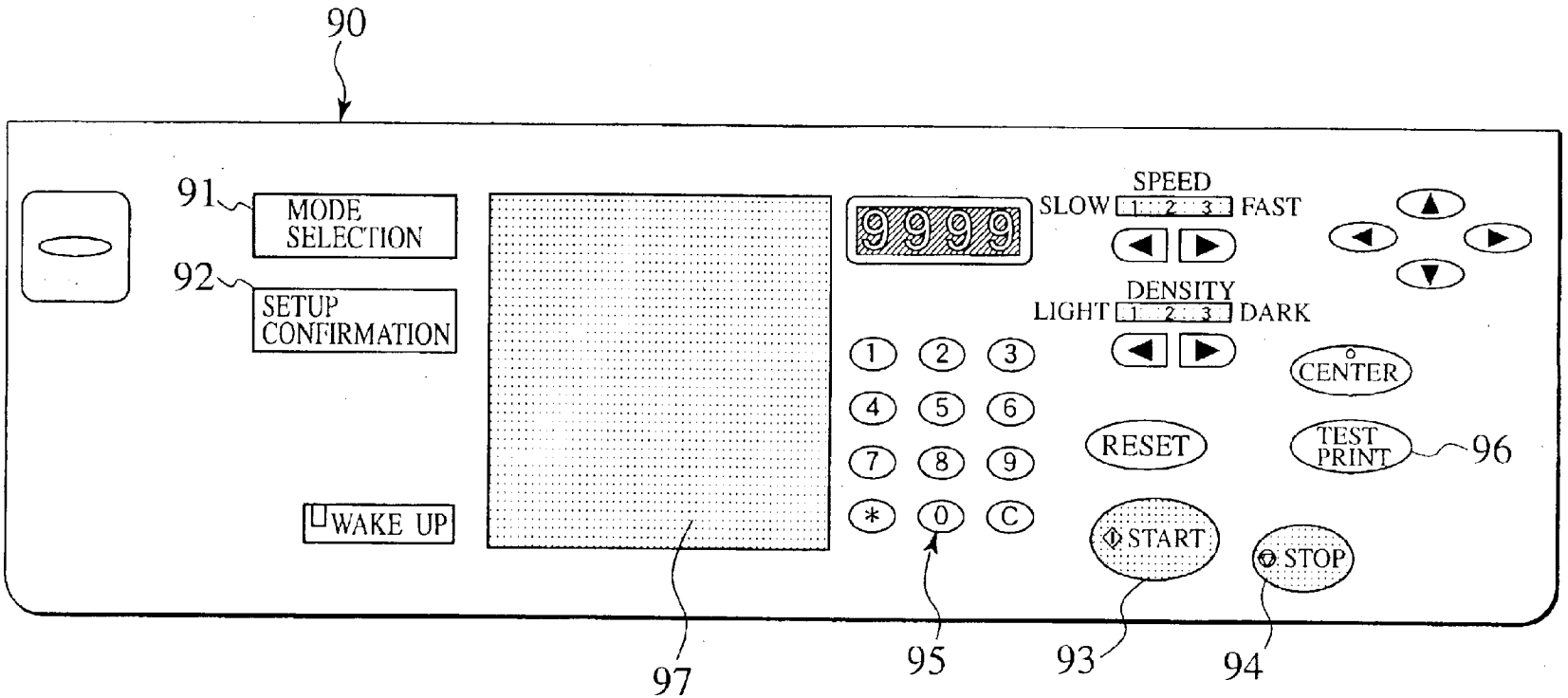
FIG. 6 is an illustration showing the example of a layout of the operation panel in the stencil printing apparatus shown in FIG. 1.

As shown in FIG. 6, a control panel 90 is located on the top surface of the stencil printing apparatus. The control panel 90 has a mode selection key 91, a setup confirmation key 92, a start key 93, a stop key 94, a ten-key 95, a test print key 96, and the like. The mode selection key 91 is a key for the selection of processing modes (on-line mode/off-line mode), such as stencil making and printing. The setup confirmation key 92 is a key for confirming the processing modes set by the mode selection key 91. The start key 93 is a key for starting a stencil making or printing process by the selected processing mode. The stop key 94 is a key for stopping the stencil making or printing process. The ten-key 95 is a key for inputting the number of print sheets or the like. The test print key 96 is a key for carrying out a test print process.

Further, a liquid crystal display touch panel 97 to display various parameters is arranged on the control panel 90. A menu button selecting the paper supply tray (not shown in the Figs.) is arranged in the liquid crystal display touch panel 97. If the menu button selecting the paper supply tray is pushed, it changes to a tray-specified screen for the choice of any tray from among the main body tray 41, the upper frame tray 53, and the lower frame tray 57.

Furthermore, although not shown in the Figs., enlargement/reduction mode setting button for performing enlargement or reduction processing of the image read by the original scanning section 1 is prepared in the liquid crystal display touch panel 97.

Control Section

As shown in FIG. 7, the stencil printing apparatus has a control section 100 (Central Processing Unit (CPU)). The control section 100 centralizes control of the original scanning section 1, the stencil making section 2, the printing section 3, the paper supply section 4, the paper discharge section 120, the stencil discharge section 130, the drive motor 101, 104 and 105, the side fence motor 68, and the end fence motor 71, and controls the display on the control panel 90, based on the input data from the control panel 90 and the output signals from the paper detection sensor 102, 106 and 103, the paper size sensor 108 and 109, the full receiving tray sensor 74, the side fence home position sensor 110, the end fence home position sensor 111, and a controller 112.

Moreover, the control section 100 controls a Read Only Memory (ROM) 113 to store various programs and a Random Access Memory (RAM) 114, controls writing/reading processes for the storage section 115, and chooses any one tray from among the main body tray 41, the upper frame tray 53 and the lower frame tray 57 and controls the feeding of the print paper 37 from the chosen tray. The storage section 115 functions as a job memory section to store printing jobs.

Here, the controller 112 functions as the communications section to communicate with computers 116 connected directly, or via a network. The controller 112 is constituted so that the printing data transmitted from the computers 116 is able to print with the stencil printing apparatus. In addition, as to the network, closed networks such as Local Area Network (LAN) and intranet, and open networks such as the Internet, etc. are included. Moreover, the controller 112 changes the printing data transmitted from the computers 116 into the data format to print in the stencil printing apparatus. In addition, in the above-mentioned FIG. 7, although the controller 112 is integrated with the stencil printing apparatus, the controller 112 can also be constituted as a discrete device independent from the stencil printing apparatus.

Processing Operation of Stencil Printing Apparatus

First Embodiment

In the case where the present stencil printing apparatus reads image data via the original scanning section 1 and performs the stencil printing processing using the read image data, the present stencil printing apparatus performs the stencil printing processing sequentially, starting from a printing job with the smallest paper size to be outputted. That is, the present stencil printing apparatus is constituted as a printing apparatus for operating on a stand-alone basis. In addition, in this specification, the mode that performs the stencil printing processing using the image data read from the paper original via the original scanning section 1 is called "Paper to Paper (P-to-P) Mode". Hereafter, with reference to the flow charts shown in FIGS. 8A and 8B, the processing operation of the stencil printing apparatus performing stencil printing processing using the P-to-P mode is explained.

Figure 8A:
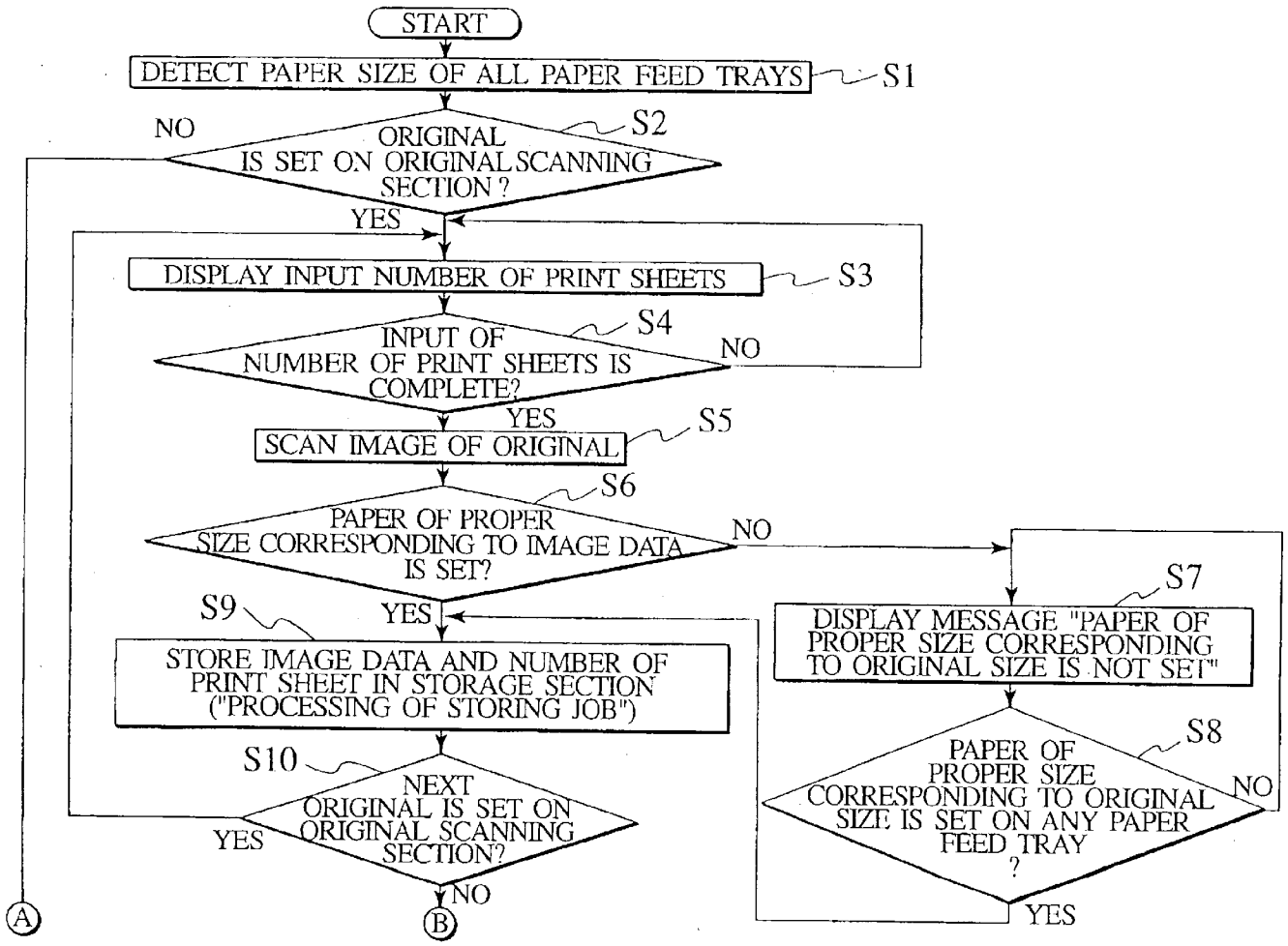
FIGS. 8A and 8B are flow charts showing the example of the processing operation in the first embodiment of the stencil printing apparatus shown in FIG. 1.
Figure 8B:
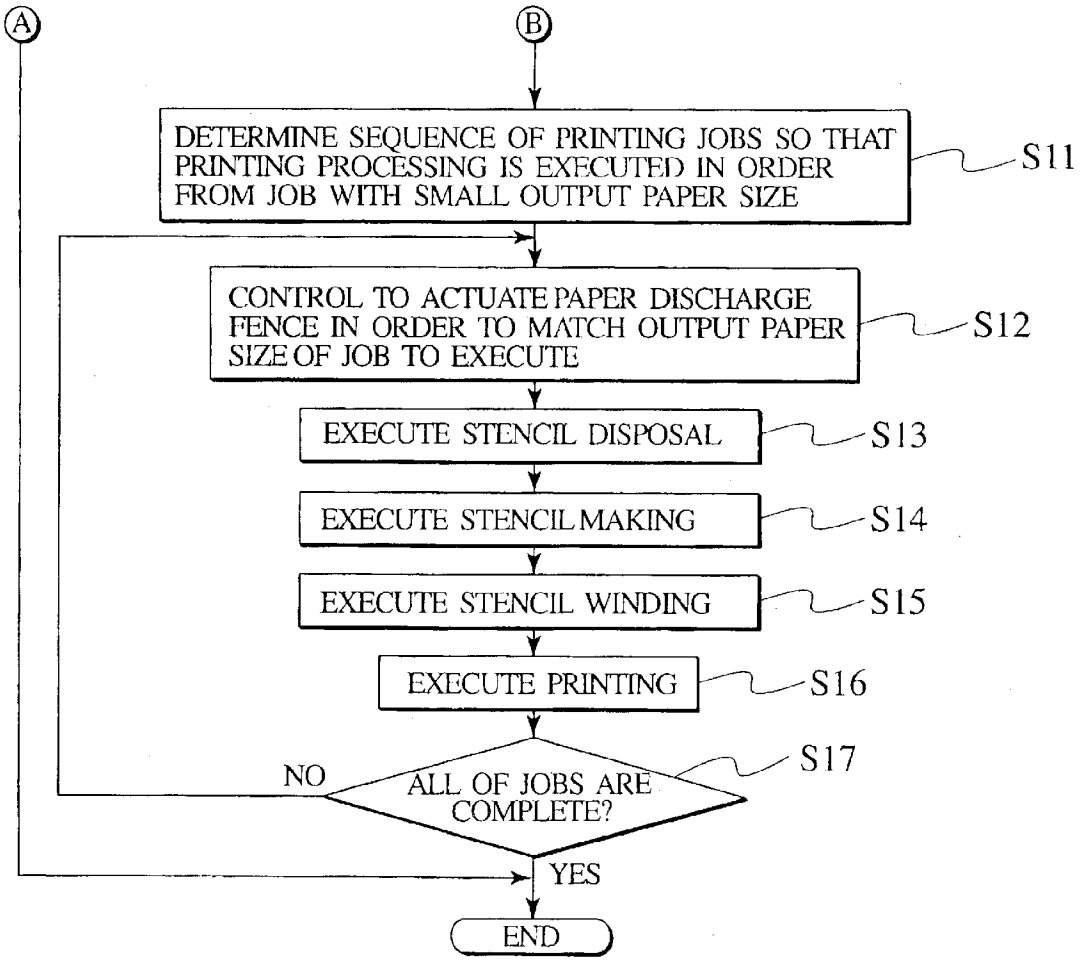

In the flowcharts shown in FIGS. 8A and 8B, a user operates the mode selection key 91 on the control panel 90 in order to set the processing mode of the stencil printing apparatus to P-to-P mode, and switches to the "Paper Size Priority Mode" to perform sequentially, starting from a printing job with the smallest paper size of the print paper 37 to be outputted, from "Normal Printing Mode" to perform printing jobs in the order in which they were inputted. The above-mentioned operation of the user triggers the start of the printing processing.

In Step S1, the control section 100 detects the size of the print paper 37 set on the main body tray 41 based on the output signal from the paper size sensor 103, detects the size of the print paper 37 set on the upper frame tray 53 based on the output signal from the paper size sensor 108, and detects the size of the print paper 37 set on the lower frame tray 57 based on the output signal from the paper size sensor 109.

In addition, in a stencil printing apparatus driving only the side fences 64 and 65 to adjust the width direction size of the print paper 37, the detection of the paper size is judged only by the size of the width direction of the print paper 37. Therefore, for example, it is judged that the print paper 37 of A4-size (width 210 mm×length 297 mm) set on the paper supply section 4 in landscape orientation is larger than the paper of B4-size (width 257 mm×length 364 mm) set on the paper supply section 4 in portrait orientation. Here, the "portrait orientation" is a way of placing the paper so that the long side of the rectangular paper becomes parallel to the paper transfer direction. Further, the "landscape orientation" is a way of placing the paper so that the short side of the rectangular paper becomes parallel to the paper transfer direction.

On the other hand, as explained in this embodiment, in the stencil printing apparatus driving not only the side fences 64 and 65, but also the end fence 66 in which the edge of the print paper 37 interferes according to paper size, the detection of paper size is judged based on the size of not only the width direction, but also the length direction of the print paper 37. In addition, the width direction means a right-angled direction in the conveyance direction of the print paper 37, and the length direction means the conveyance direction of the print paper 37. In this case, with the print paper 37 of A4-size set to the paper supply section 4 in landscape orientation, and the print paper 37 of B4-size set to the paper supply section 4 in portrait orientation, the A4-size paper is larger than the B4-size paper in the width direction, but the B4-size paper is larger than the A4-size paper in the length direction. Thus, the relations of the paper sizes differ in the width direction and the length direction. Therefore, in the stencil printing apparatus driving both the side fences 64 and 65 and the end fence 66, the portrait orientation of the print paper 37 is used as the standard of the direction of the paper in the "Paper Size Priority Mode", and when the landscape orientation of the print paper 37 is detected, the selection of the "Paper Size Priority Mode" is forbidden as an error.

Thereby, the processing in Step S1 is completed, and next, this printing processing goes to Step S2.

In Step S2, the control section 100 detects whether a original is set on the original set tray 10 with reference to the output signal from the original sheet sensors 11 and 12. As a result of the detection, if no original is set on the original set tray 10, this series of the printing processing is ended. On the other hand, if the original is set on the original set tray 10 as a result of the detection, this printing processing goes to Step S3.

In Step S3, the control section 100 urges the user to input the number of print sheets on the control panel 90, and displays the inputted number of print sheets on the liquid crystal display touch panel 97. Thereby, the processing in Step S3 is completed, then, this printing processing goes to Step S4.

In Step S4, a control section 100 supervises whether the user has pushes the start key 93 in order to distinguish whether the input of the number of the print sheets is completed. In addition, this distinction processing is in the case where the start key 93 is used for discriminating setting continuation in the "Paper Size Priority Mode", or a "continuation key" may be prepared in the control panel 90 instead of this distinction processing.

As a result of the distinction, if the input of the number of print sheets is not completed, this printing processing returns to Step S3. On the other hand, if the input of the number of the print sheets is completed as a result of the distinction, this printing processing goes to Step S5.

In Step S5, the control section 100 controls the original scanning section 1 so as to scan an image of the original set on the original set tray 10. Thereby, the processing in Step S5 is completed, then, this printing processing goes to Step S6.

In Step S6, the control section 100 distinguishes whether the print paper 37 of the proper size corresponding to the size of the scanned image data is set on either the main body tray 41, the upper frame tray 53, or the lower frame tray 57, based on the read image data. As a result of the distinction, if no print paper 37 of the proper size corresponding to the size of the image data is set, this printing processing goes to Steps S7 and S8.

In Step S7, the control section 100 displays a message that no print paper 37 of the proper size corresponding to the size of the image data is set, on the liquid crystal display touch panel 97.

In Step S8, the control section 100 distinguishes whether the print paper 37 of the proper size corresponding to the size of the image data is set on the paper tray of either the main body tray 41, the upper frame tray 53, or the lower frame tray 57 with reference to the output from the paper size sensor 103 of the main body tray 41, the paper size sensor 108 of the upper frame tray 53, and the paper size sensor 109 of the lower frame tray 57. Then, the processing of steps S7 to S8 is repeated until the print paper 37 of the proper size corresponding to the size of the image data is set on the paper tray of either the main body tray 41, the upper frame tray 53, or the lower frame tray 57. If the print paper 37 of the size corresponding to the size of the image data is set on the paper tray, this printing processing goes to Step S9.

On the other hand, as a result of the distinction in Step S6, if the print paper 37 of the proper size corresponding to the size of the image data is set, this printing processing goes to Step S9 from Step S6.

In Step S9, the control section 100 stores the image data read by controlling the original scanning section 1 and the information of the image forming processing such as the number of print sheets inputted from the ten-key 95 of the control panel 90 by the user, as a printing job to be performed in the storage section 115 ("processing of storing job").

Thereby, the processing in Step S9 is completed, and next, this printing processing goes to Step S10.

In Step S10, the control section 100 detects whether the following original is set on the original scanning section 1 with reference to the output signal from the original sheet sensors 11 and 12. As a result of the distinction, if the following original is set on the original scanning section 1, this printing processing returns to the above-mentioned Step S3, then, the processing of the above-mentioned steps S3 to S10 are repeated until the original to be read is empty.

On the other hand, as a result of the distinction in Step S10, if no following original is set on the original scanning section 1, this printing processing goes to Step S11.

In Step S11, the control section 100 determines the sequence of each printing job stored in the storage section 115 so that printing processing is executed in order from a printing job with the smallest paper size of the width direction of the print paper 37. In addition, if there are two or more printing jobs with the same output paper size, the control section 100, for example, just determines the sequence of each printing job according to the input sequence of the printing jobs.

Thereby, the processing in Step S11 is completed, and next, this printing processing goes to Step S12.

In Step S12, the control section 100 controls the actuation of the pair of side fences 64 and 65 and the end fence 66 through the fence actuator 67 in order to match the output paper size of the printing job to be executed.

Thereby, the processing in Step S12 is completed, and next, this printing processing goes to Step S13.

In Step S13, the control section 100 controls the stencil discharge section 130 to remove the used stencil sheet 18 wound around the drum 26, and to discharge the used stencil sheet 18 into the stencil discharge box 83 ("processing of stencil discharge").

Thereby, the processing in Step S13 is completed, and next, this printing processing goes to Step S14.

In Step S14, the control section 100 controls the stencil making section 2 to perforate stencil sheet 18 in order to form the image data concerning the printing job ("processing of stencil making").

Thereby, the processing in Step S14 is completed, and next, this printing processing goes to Step S15.

In Step S15, the control section 100 controls the stencil making section 2 and the printing section 3 to wind the stencil sheet 18 perforated by the stencil making processing around the drum 26 ("processing of stencil winding").

Thereby, the processing in Step S15 is completed, and next, this printing processing goes to Step S16.

In Step S16, the control section 100 controls the printing section 3 to rotate the drum 26, to feed the print paper 37 from the paper supply section, synchronizing with the rotation of the drum 26, to press the fed print paper 37 with the press roll 35 against the stencil sheet 18 wound around the drum 26 so that ink 34 is transferred to the print paper 37 to form the printed image, and to discharge the printed print paper 37 to the paper discharge section 120 ("processing of printing"). Then, the control section 100 executes this printing processing for the specified number of the print sheets.

Thereby, the processing in Step S16 is completed, and next, this printing processing goes to Step S17.

In Step S17, the control section 100 distinguishes whether all the printing jobs stored in the storage section 115 are completed. As a result of the distinction, if all the printing jobs are not completed, printing processing returns to the above-mentioned Step S12, then, the processing of the above-mentioned steps S12 to S17 is repeated until all the printing jobs are completed.

On the other hand, as a result of the distinction in Step S17, if all printing jobs are completed, the control section 100 changes the processing mode of the stencil printing apparatus from "Paper Size Priority Mode" to "Normal Mode", and ends the series of the printing processing.

As explained above, the image forming apparatus according to this embodiment includes the following composition elements.

(a) The plural paper supply sections 4 having the paper size sensors 103, 108 and 109 to detect the size of the print paper 37 set on the paper feed tray;

(b) the original scanning section 1 to read the original image of two or more paper sizes;

(c) the input section (the ten-key 95 of the control panel 90) for inputting the image formation processing information including the information about at least the image formation sheet number at least;

(d) the image forming section (the printing section 3) to form the read image onto the print paper 37 fed from the paper supply sections 4;

(e) the paper discharge section 120 to stock the print paper 37 formed of the image by the image forming section;

(f) the auto fence to displace the position of the width direction of the print paper 37 stocked on the paper discharge section 120 according to the paper size of the print paper 37 fed from the paper supply sections 4;

(g) the job memory (the storage section 115) to store the image forming processing as the printing job in the image for 1 page unit; and (h) the control section 100 which determines the sequence of each printing job stored in the storage section 115 so that printing processing is executed in order from a printing job with the smallest paper size in the width direction of the print paper 37.

According to the above composition, the positions of the side fences 64 and 65 controlled so as to be are moved in the spreading direction as the paper size shifts to a printing job with large paper size to perform image forming printing processing from a printing job with the smallest size of the print paper 37 when two or more printing jobs are stored in the storage section 115. Therefore, even if the print paper 37 currently stocked onto the paper discharge section 120 is not removed, the image forming processing of two or more paper sizes can be performed continuously.

Furthermore, the auto fence can also be considered as a composition including the end fence 66 in which the leading edge of the print paper 37 interferes, in addition to the side fences 64 and 65, in which the end fence 66 displaces the position of the length direction of the print paper 37 according to the paper size of the print paper 37.

Second Embodiment

In this second embodiment, in the case where the present stencil printing apparatus receives image data from the computer(s) 116 directly or via a network and performs stencil printing processing using the received image data, the present stencil printing apparatus to perform the stencil printing processing sequentially from a printing job with the smallest paper size to be outputted is explained. In addition, in this specification, the mode for performing the stencil printing processing using the image data received from the computer(s) 116 is called "Data to Paper (D-to-P) Mode". Hereafter, with reference to the flow charts shown in FIGS. 9A and 9B, the processing operation of the stencil printing apparatus performing stencil printing processing using the D-to-P mode is explained.

Figure 9A:
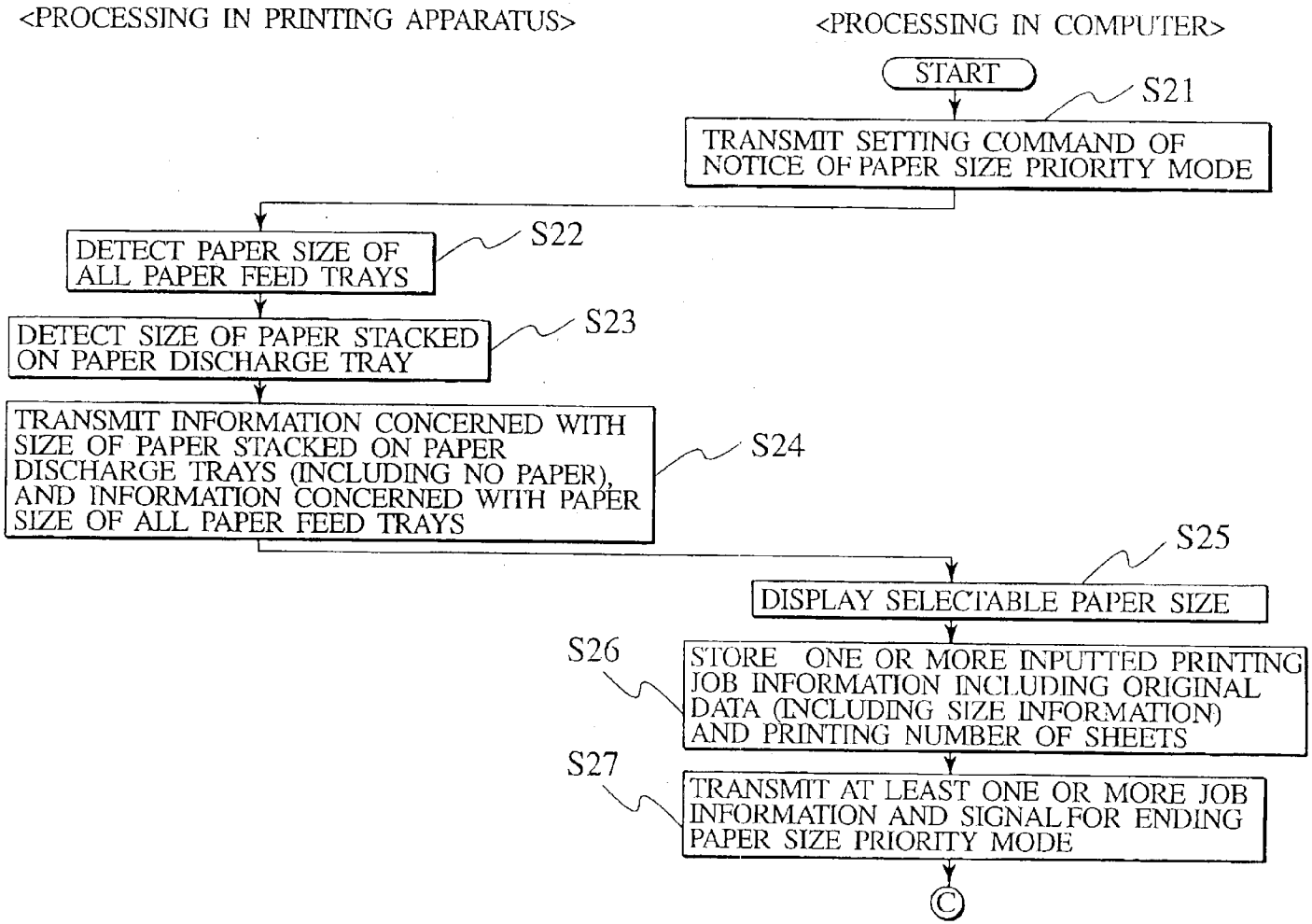
FIGS. 9A and 9B are flow charts showing the example of the processing operation in the second embodiment of the stencil printing apparatus shown in FIG. 1.
Figure 9B:
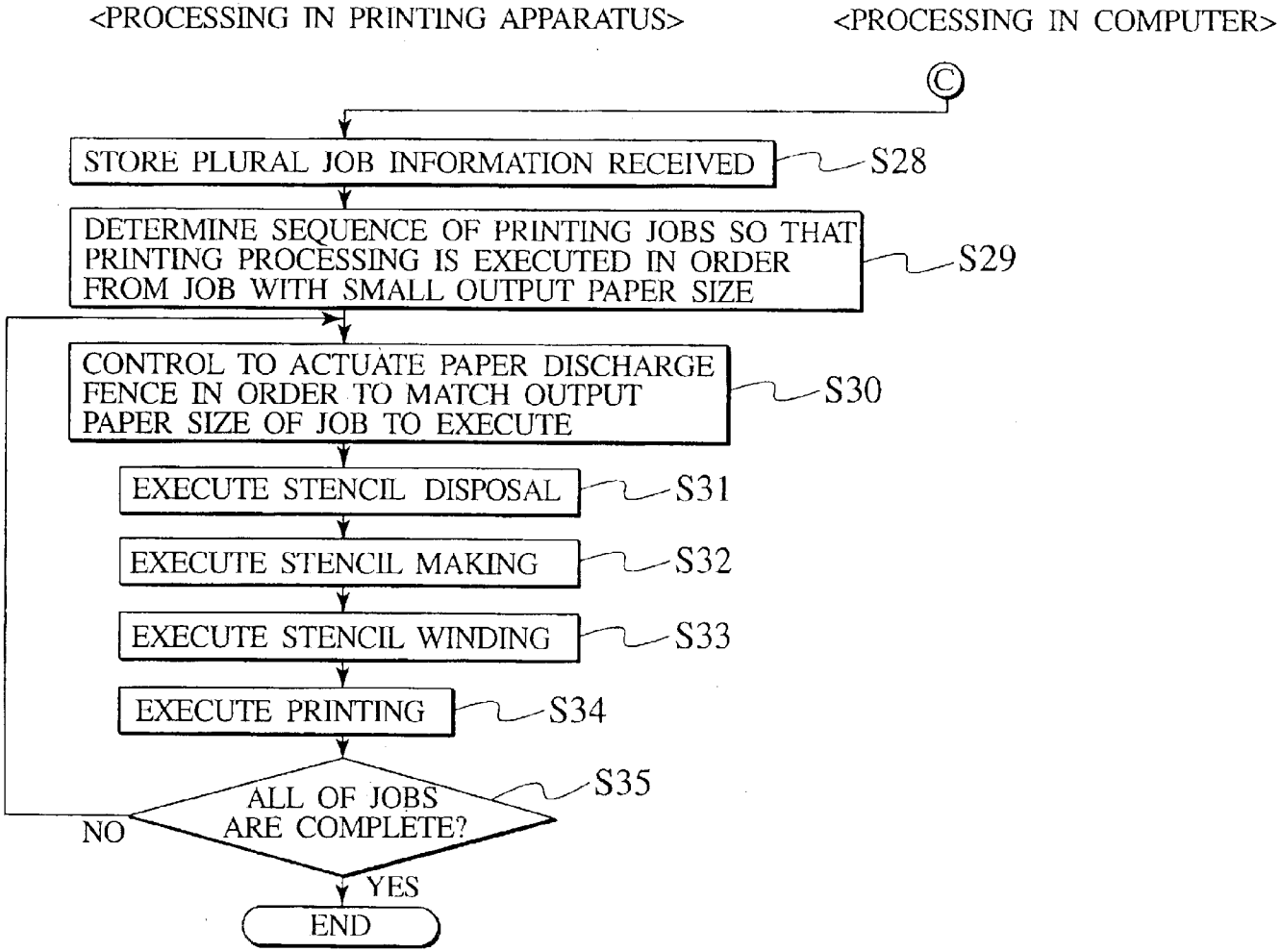

In the flow charts shown in FIGS. 9A and 9B, the printing processing is started when the stencil printing apparatus connects with the computer 116 via directly or a network through the controller 112, and this printing processing goes to Step S21. In addition, in the following printing processing, the stencil printing apparatus is in a standby state until receiving the printing job.

In Step S21, the computer 116 transmits the setting command notice of the "Paper Size Priority Mode" to the stencil printing apparatus.

Thereby, the processing in Step S21 is completed, and next, this printing processing goes to Step S22.

In Step S22, the control section 100 of the stencil printing apparatus responds accordingly for receiving the setting command notice, and switches the processing mode of the stencil printing apparatus to the "Paper Size Priority Mode" from the "Standby State". Then, the control section 100 detects the size of the print paper 37 set on the main body tray 41 based on the output signal from the paper size sensor 103, detects the size of the print paper 37 set on the upper frame tray 53 based on the output signal from the paper size sensor 108, and detects the size of the print paper 37 set on the lower frame tray 57 based on the output signal from the paper size sensor 109.

Thereby, the processing in Step S22 is completed, and next, this printing processing goes to Step S23.

In Step S23, the control section 100 of the stencil printing apparatus detects the existence of the paper on the paper receiving tray 63 using the output signal of the paper detection sensor 75. At the same time, if the paper is stacked on the paper receiving tray 63, the control section 100 detects the paper size on the paper receiving tray 63 by computing the position of the side fences 64 and 65 and the end fence 66 at this time.

Thereby, the processing in Step S23 is completed, and next, this printing processing goes to Step S24.

In Step S24, the control section 100 of the stencil printing apparatus transmits the information about the size of the print paper 37 currently stacked on the paper receiving tray 63 (the case where there is no print paper 37 currently stacked is included), and the information about the size of the print paper 37 set on the main body tray 41, the upper frame tray 53, and the lower frame tray 57, to the computer 116.

Thereby, the processing in Step S24 is completed, and next, this printing processing goes to Step S25.

In Step S25, the computer 116 displays the paper size, which can be chosen, on the display of the computer 116 based on the information received from the control section 100.

Thereby, the processing in Step S25 is completed, and next, this printing processing goes to Step S26.

In Step S26, the computer 116 stores at least one or more inputted printing jobs in the storage section in the computer 116, in response to input of the image forming processing information by the user, such as the data of the original (including the paper size information) and the number of the print sheets, as the printing job with reference to the paper size which can be chosen.

Thereby, the processing in Step S26 is completed, and next, this printing processing goes to Step S27.

In Step S27, the computer 116 transmits at least one or more printing jobs stored in the storage section to the stencil printing apparatus, and further transmits the end command of the "Paper Size Priority Mode" to the stencil printing apparatus.

Thereby, the processing in Step S27 is completed, and next, this printing processing goes to Step S28.

In Step S28, the control section 100 of the stencil printing apparatus stores at least one or more printing jobs transmitted from the computer 116 in the storage section 115.

Thereby, the processing in Step S28 is completed, and next, this printing processing goes to Step S29.

In Step S29, the control section 100 determines the sequence of each printing job stored in the storage section 115 so that printing processing is executed in order from a printing job with the smallest paper size in the width direction of the print paper 37. Thereby, the processing in Step S29 is completed, and the control section 100 executes the printing processing in order from a printing job with the smallest output paper size with reference to all printing jobs, by executing the processing of step S30 to step S35, similar to the processing of step S12 to step S17 in the first embodiment. Then, if the printing processing is completed with reference to all printing jobs, the control section 100 changes the processing mode of the stencil printing apparatus from the "Paper Size Priority Mode" to the "Standby State", and completes the series of the printing processing.

Thus, the control section 100 of the stencil printing apparatus stores the printing job transmitted from the computer 116 in the storage section 115, after receiving the preliminary notice command in the "Paper Size Priority Mode" from the computer 116 before receiving the end command in the "Paper Size Priority Mode". Then, the control section 100 executes the printing processing in order from a printing job with the smallest paper size in the width direction of the print paper 37 with reference to all printing jobs stored in the storage section 115, after receiving the end command of the "Paper Size Priority Mode". Therefore, even if the print paper 37 currently stacked on the paper discharge section 120 is not removed, the image forming processing of two or more paper sizes can be performed continuously.

Here, in above-mentioned step S29, if there is a printing job which cannot be executed, the control section 100 displays information about the printing job on the liquid crystal display touch panel 97 or on the display of the computer 116, deletes the printing job, and determines the printing sequence with reference to the remaining printing jobs. In addition, the "printing job which cannot be executed" is a printing job which has neither the printing job which uses the print paper 37 of the paper size of the width direction smaller than the paper size of the width direction of the print paper 37 currently stacked on the paper receiving tray 63, nor the print paper 37 of the size to be used in any paper feed tray. In addition, when there is a printing job that cannot be executed, the control section 100 may display error information on the liquid crystal display touch panel 97 or the display of the computer 116, and may stop the printing processing operation. Moreover, when there is a printing job which uses the print paper 37 of the size of the width direction smaller than the paper size of the width direction of the print paper 37 currently stacked on the paper receiving tray 63, whether the printing job which cannot be executed is excepted and the remaining printing jobs are executed, or error information is displayed and the printing processing operation is stopped, is enabled so as to be chosen and set up by the user.

As explained above, in addition to the composition element of the first embodiment, the image forming apparatus according to the second embodiment includes the communications section (the controller 112) connecting with the information processing apparatus (the computer 116) and receiving the original image and the image forming processing information which includes at least the information about the number of the sheets of the picture formation from the computer 116.

By such composition, the original image of two or more paper sizes can be sent to the stencil printing apparatus from the computer 116 stationed in a remote place, and two or more image forming processes can be executed continuously. Therefore, according to the second embodiment, in the image forming apparatus equipped with the auto fence mechanism, the image forming processing of two or more paper sizes can be executed continuously, stocking the paper on the paper receiving tray.

In addition, during the printing processing execution shown in FIGS. 8A and 8B or FIGS. 9A and 9B, if the output signal of the full receiving tray sensor 74 is turned "ON" in the case where the paper receiving tray 63 is full of the print paper 37 is detected, the control section 100 interrupts the printing processing and displays a message signaling that the paper receiving tray 63 is filled, on the liquid crystal display touch panel 97 or the display of the computer 116. And if the output signal of the full receiving tray sensor 74 is turned "OFF" and the printing continuation operation is performed, the control section 100 will resume the interrupted printing processing.

Furthermore, in the printing processing shown in FIGS. 8A and 8B or FIGS. 9A and 9B, although it is possible to input only the information about the number of sheets of image forming besides the image data as the job of each image unit, it is possible to collectively input not only the number of sheets for image forming but also information regarding other image forming issues, such as the paper size to be formed, the image, the rate of enlargement/reduction, negative positive reversal, etc.

When the rate of enlargement/reduction is inputted, the control section 100 can distinguish the size of the print paper 37 used for printing processing based on the original size and the rate of enlargement/reduction. Moreover, when the paper size is inputted, the control section 100 can determine the rate of enlargement/reduction based on the original size and the paper size to be used, and control the printing processing according to the determined rate of enlargement/reduction.

In each of the above-mentioned embodiments, although the case where the stencil printing system is used as the image forming section was shown, various image forming systems such as an electronic photograph system or an ink jet system can be used, as the image forming section.

Thus, the present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

This application claims benefit of priority under 35 USC §119 to Japanese Patent Application No. 2002-223512 filed on Jul. 31, 2002, the entire contents of which are incorporated by reference herein.

What is claimed is:

1. An apparatus for forming an image comprising:

a plurality of paper supply sections having a paper size sensor to detect a size of a print paper set on;

an image forming section forming an image on the print paper fed from the paper supply sections;

a paper discharge section stocking the print paper formed of the image and discharged;

an auto fence located on the paper discharge section, and displacing the position of a width direction of the print paper stocked on the paper discharge section according to the paper size of the print paper fed from the paper supply sections;

a storage section storing the image forming processing as the printing job in the image for one page unit; and a control section determining a sequence of each printing job stored in the storage section so that printing processing is executed in order from a printing job with the smallest paper size in the width direction of the print paper.

2. The apparatus of claim 1, wherein the auto fence has an end fence in which the edge of the print paper interferes, and the end fence displaces the position of a paper transfer direction of the print paper according to the paper size of the print paper automatically.

3. The apparatus of claim 2, further comprising:

an original scanning section reading an original image of two or more paper sizes; and an input section inputting the image formation processing information including at least information about the image formation sheet number.

4. The apparatus of claim 2, further comprising a controller connecting with an information processing apparatus directly or via a network, and receiving the original image and the image forming processing information including at least the information about the number of the sheets of the picture formation from the information processing apparatus.

5. The apparatus of claim 1, further comprising:

an original scanning section reading an original image of two or more paper sizes; and an input section inputting the image formation processing information including at least information about the image formation sheet number.

6. The apparatus of claim 5, further comprising a controller connecting with an information processing apparatus directly or via a network, and receiving the original image and the image forming processing information including at least the information about the number of the sheets of the picture formation from the information processing apparatus.

7. The apparatus of claim 1, further comprising a controller connecting with an information processing apparatus directly or via a network, and receiving the original image and the image forming processing information including at least the information about the number of the sheets of the picture formation from the information processing apparatus.

8. A system for forming an image comprising an information processing apparatus for inputting an original image and image forming processing information including at least information about the image formation sheet number, and an apparatus for forming an image including:

a controller receiving the original image and the image forming processing information from the information processing apparatus;

a plurality of paper supply sections having a paper size sensor to detect a size of a print paper set on;

an image forming section forming an image on the print paper fed from the paper supply sections, based on the original image;

a paper discharge section to stock the print paper formed of the image and discharged;

an auto fence located on the paper discharge section, to displace the position of a width direction of the print paper stocked on the paper discharge section according to the paper size of the print paper fed from the paper supply sections;

a storage section to store the image forming processing as the printing job in the image for one page unit; and a control section determining a sequence of each printing job stored in the storage section so that printing processing is executed in order from a printing job with the smallest paper size in the width direction of the print paper.

9. The system of claim 8, wherein the auto fence has an end fence in which the edge of the print paper interferes, and the end fence displaces the position of a paper transfer direction of the print paper according to the paper size of the print paper automatically.

10. The system of claim 9, wherein the apparatus further including:

an original scanning section reading an original image of two or more paper sizes; and an input section inputting the image formation processing information including at least information about the image formation sheet number.

11. The system of claim 9, wherein the apparatus further including a controller connecting with an information processing apparatus directly or via a network, and receiving the original image and the image forming processing information including at least the information about the number of the sheets of the picture formation from the information processing apparatus.

12. The system of claim 9, wherein the apparatus further including a controller connecting with an information processing apparatus directly or via a network, and receiving the original image and the image forming processing information including at least the information about the number of the sheets of the picture formation from the information processing apparatus.

13. The system of claim 8, wherein the apparatus further including:

an original scanning section reading an original image of two or more paper sizes; and an input section inputting the image formation processing information including at least information about the image formation sheet number.

14. The system of claim 8, wherein the apparatus further including a controller connecting with an information processing apparatus directly or via a network, and receiving the original image and the image forming processing information including at least the information about the number of the sheets of the picture formation from the information processing apparatus.

15. A method for controlling an image forming apparatus, the method comprising:

detecting a size of a print paper set on a plurality of paper supply sections;

storing image forming processing as the printing job in the image for one page unit in a storage section;

determining a sequence of each printing job stored in the storage section so that printing processing is executed in order from a printing job with the smallest paper size in a width direction of the print paper; and displacing of the position of the width direction of the print paper stocked on the paper discharge section according to the paper size of the printing job, feeding the print paper from the paper supply sections, forming an image on the print paper fed from the paper supply sections in an image forming section, and discharging and stocking the print paper formed of the image on a paper discharge section, are executed according to the sequence.

16. The method of claim 15, wherein before the storing the printing job, the method further comprises:

reading an original image for forming the image of two or more paper sizes in an original reading section; and inputting the image formation processing information including at least information about the image formation sheet number from an input section.

17. The method of claim 15, wherein before the storing the printing job, the method further comprises connecting with an information processing apparatus directly or via a network, and receiving the original image and the image forming processing information including at least the information about the number of the sheets of the picture formation from the information processing apparatus.

* * * * *